United States Patent [19]

Gardner

[11] 4,076,493

[45] Feb. 28, 1978

[54] APPARATUS FOR COOLING PARTICULATE MATERIAL

[75] Inventor: Kenneth L. Gardner, Riverside, Pa.

[73] Assignee: Kennedy Van Saun Corporation, Danville, Pa.

[21] Appl. No.: 721,673

[22] Filed: Sep. 9, 1976

[51] Int. Cl.[2] ..... F27D 15/02

[52] U.S. Cl. ..... 432/77; 34/13; 432/78; 432/80

[58] Field of Search ..... 432/77, 78, 79, 80; 34/13

[56] References Cited

U.S. PATENT DOCUMENTS

| | | | |
|---|---|---|---|
| 1,533,931 | 4/1925 | Lummis | 214/18 V |
| 2,858,123 | 10/1958 | Niems | 432/78 |
| 3,578,297 | 5/1971 | Niems | 432/80 |
| 3,779,698 | 12/1973 | Siemssen | 432/79 |
| 3,815,253 | 6/1974 | Deussner | 432/78 |
| 3,837,792 | 9/1974 | Deussner | 432/77 |

*Primary Examiner*—John J. Camby
*Attorney, Agent, or Firm*—Brumbaugh, Graves, Donohue & Raymond

[57] ABSTRACT

Apparatus for cooling calcined or sintered particulate material discharged from a rotary kiln or other pyroprocessing system. The apparatus includes an upright shell adapted to contain the material to be cooled, a mixing hopper arranged within the upper portion of the shell for mixing together particles of the material of different size and air distributing means arranged within the lower portion of the shell for releasing cooling air into the material. The apparatus is configured so that the cooling air moves counter to the direction of material flow.

37 Claims, 6 Drawing Figures

APPARATUS FOR COOLING PARTICULATE MATERIAL

BACKGROUND OF THE INVENTION

The present invention relates to apparatus for cooling particulate material such as lime, cement, lightweight aggregate, ores and the like which have calcined or sintered in a rotary kiln or other pyroprocessing system.

It is known to provide a stationary contact cooler for containing hot particulate material discharged from a rotary kiln within an insulated, upright shell while supplying cooling air thereto by an appropriately dimensioned blower. After passing through the material, this cooling air is either vented to the atmosphere or used as combustion air for the calcining or sintering process. Apparatus of this type is disclosed, for example in the U.S. Pat. No. 3,274,701 to Gerhard Niemitz which is assigned to the assignee of the present invention.

The various types of contact cooling apparatus known in the art have disadvantages which limit the quality and efficiency of cooling.

When particles of heated material are fed into the top of the cooling apparatus, for example from a rotary kiln, they do not necessarily fall symmetrically about the central axis of the shell. Many operating variables, such as the particle size distribution, the discharge configuration of the rotary kiln, the capacity, and rotational speed of the rotary kiln, affect the point of entry of the hot particles into the shell. These parameters cannot be predicted with sufficient accuracy to properly locate the cooling apparatus relative to the rotary kiln before the unit is put into operation.

With the contact coolers known in the art, it has been assumed that the material particles are discharged from the kiln without segregation of material by particle size into the center of the cooling bed. One can observe from operating kilns, particularly large diameter kilns, that the finer particles discharge farther off of cooler center in the direction of the rotating kiln, thus creating regions in the cooler containing high concentration of fines. Since the finer particles offer a greater resistance to the flow of cooling air and air follows the path of least resistance, the air passes through the region of the cooler which has the coarser particles. As a result, maximum cooling efficiency is not achieved and the particles from the region containing high concentration of fine are discharged from the cooler at a higher temperature.

In order to remedy the unequal cooling of material particles of different size, it has been proposed to provide means for adjusting the internal mechanism of cooling apparatus to vary the air flow rates. However, it is difficult to realize such adjusting means using screw, pneumatic or hydraulic devices because they must operate in a dusty atmosphere, they must work against the material head pressure and they are subject to heat distortion.

Where adjustment means have been provided in known cooling apparatus, the adjustments have been effected symmetricaly about the central axis of the device. Actual experience with rotary kilns shows that the fine particles of material climb higher in the kiln and discharge at a point which is farther from the center line of the kiln than the point of discharge of the coarse materials. As a result, the coarse and fine material particles do not enter the cooling apparatus symmetrically about the central axis thereof so that, if only symmetrical devices are provided for adjusting the air flow, adjustments cannot be made to provide for equal cooling of these particles of different size.

Finally, the cooling apparatus known in the art is configured to provide either a cross flow of cooling air or a flow which is both counter to and concurrent with the flow of material. Neither of these configurations permits the attainment of maximum cooling efficiency where the ratio of cooling air to material quantity is reduced to a theoretical minimum.

SUMMARY OF THE INVENTION

An object of the present invention is to provide contact cooling apparatus in which particles of material of different size may be uniformly cooled.

Another object of the present invention is to provide contact cooling apparatus in which the cooling air to material quantity ratio is reduced to a minimum.

Another object of the present invention is to provide contact cooling apparatus in which material particles of different size are thoroughly mixed and deposited symmetrically about the central axis of the cooling container.

Still another object of the present invention is to provide contact cooling apparatus having externally operated dampers which permit fine asymmetrical control of the flow of air to the material.

The above-recited objects, as well as further objects which will become apparent in the discussion that follows, are achieved, according to the present invention, by providing apparatus having a cooling chamber defined within a shell or housing for receiving the hot, calcined particulate matter in the upper region thereof, an air distributor for directing the particulate matter outwardly thereof through an annular flow passage around the outer periphery of the distributor, means defining an air chamber beneath the upper surface of the air distributor and separated from the surrounding annular passage and means for discharging cooling fluid outwardly from the air chamber to cool the hot, calcined particulate matter by a countercurrent flow of the cooling fluid.

In accordance with one preferred embodiment the cooling apparatus of the present invention includes a distributor disposed centrally within the shell or housing with its upper surface flaring outwardly and downwardly to define an annular flow passage for the hot, calcined particulate material, a discharge passage at the bottom of the housing and communicating with said annular flow passage, fluid chambers beneath the upper surface of the centrally located distributor and around the annular flow passage and fluid discharge passages from both fluid chambers for cooling the particulate material by countecurrent flow through the annular flow passage.

DESCRIPTION OF THE PREFERRED EMBODIMENTS

Figure 1:
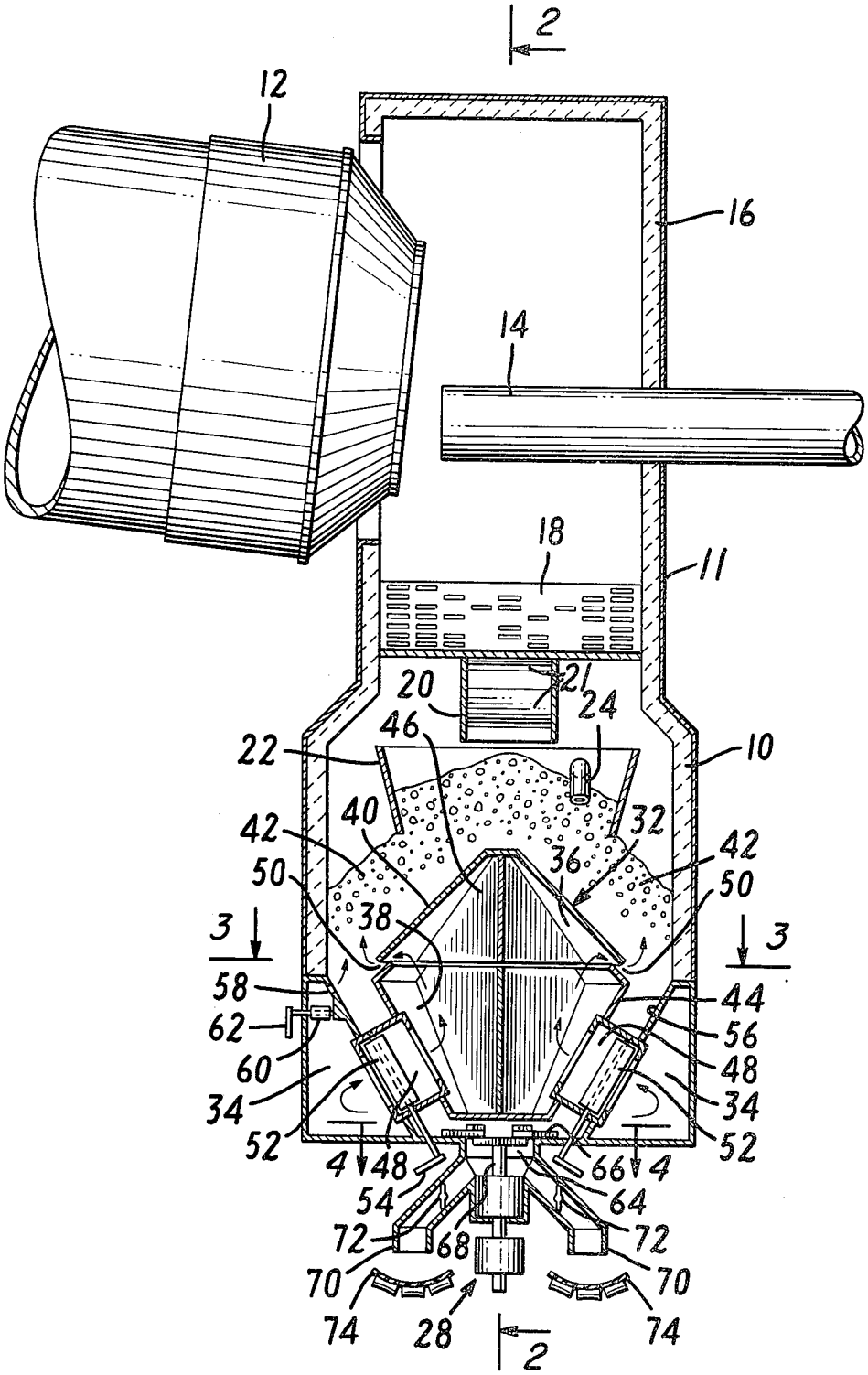
FIG. 1 is sectional side view of cooling apparatus according to a first preferred embodiment of the present invention.

The preferred embodiments of the cooling apparatus according to the present invention will now be described with reference to FIGS. 1–6 of the drawings. Identical elements illustrated in these figures are designated by the same reference numerals. For simplicity and ease of understanding only the major structural components of the cooling apparatus are shown. Support brackets for the various elements of the apparatus and other constructional details have been omitted; however, these items may be supplied in a conventional manner by persons skilled in the art.

Figure 2:
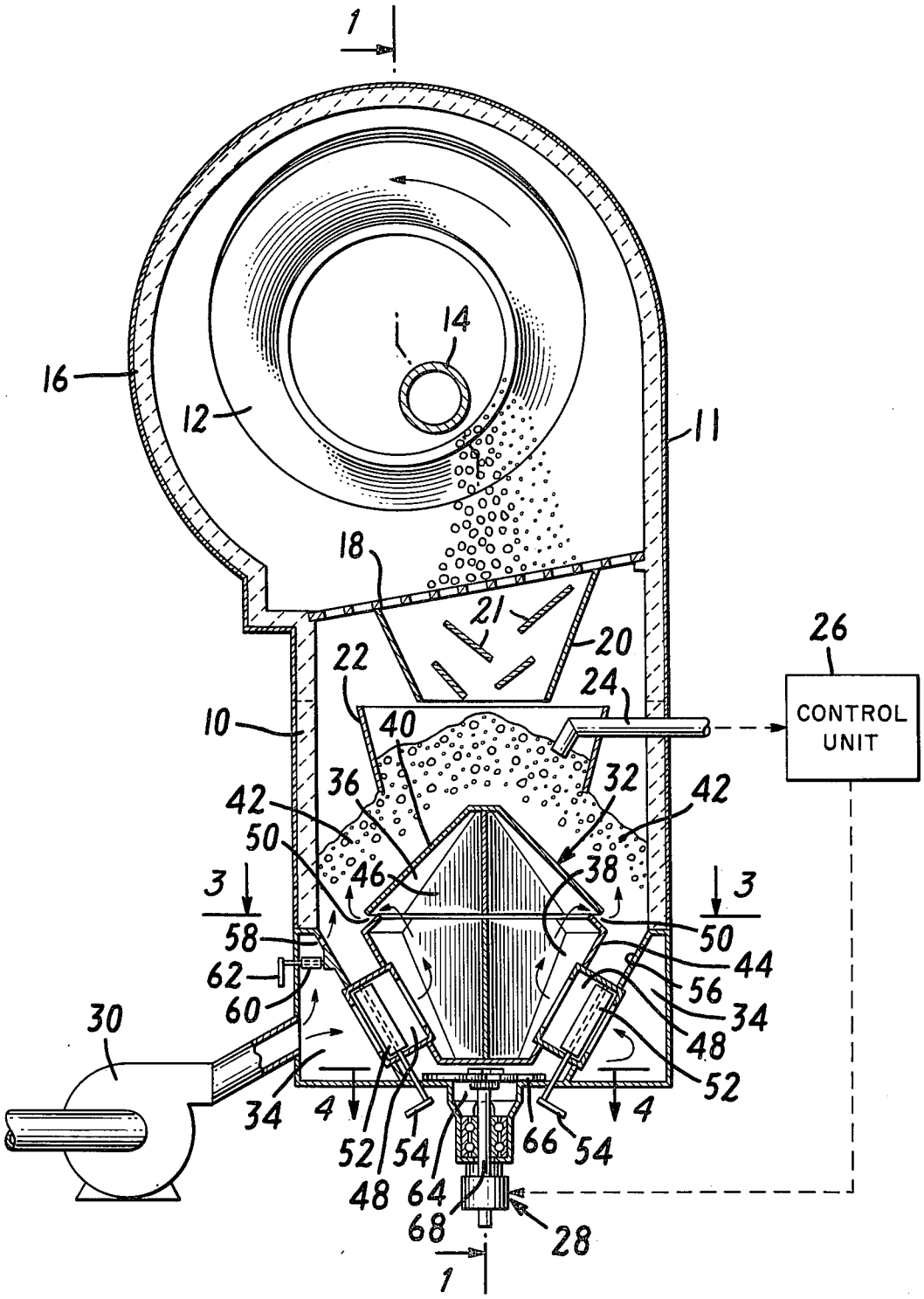
FIG. 2 is sectional front view of the apparatus of FIG. 1.

FIGS. 1–4 illustrate a first preferred embodiment of the present invention. This embodiment comprises an upright cylindrical shell made of a refractory material 10 enclosed in a steel casing 11 and adapted to receive the end of a rotary kiln 12 in wich particulate material has been calcined or otherwise heat treated. A burner 14, which can use any fuel, provides heat for the calcining or heat treating process. A firing hood 16 is provided to support the burner 14 and enclose the discharge end of the kiln. The firing hood 16 also supports an apertured grate 18 that separates scale and other foreign matter or fused particle masses from the product of acceptable size to be cooled. The grate 18, in turn, supports a mixing chute 20 which collects and thoroughly mixes the material particles discharged from the kiln and causes them to fall substantialy symmetrically about the central vertical axis of the shell 10. As is shown in FIG. 2, the fine particulate material is discharged further up the mouth of the kiln than coarse material. As these fine and coarse particles fall through the grate 18 and the mixing chute 20 they are mixed together by means of internal baffles 21 in the chute 20 that move the fine particles in the direction of the coarse particles and vice versa. Such baffles may be supported by and extend between the plates forming the sides of the chute 20.

Figure 3:
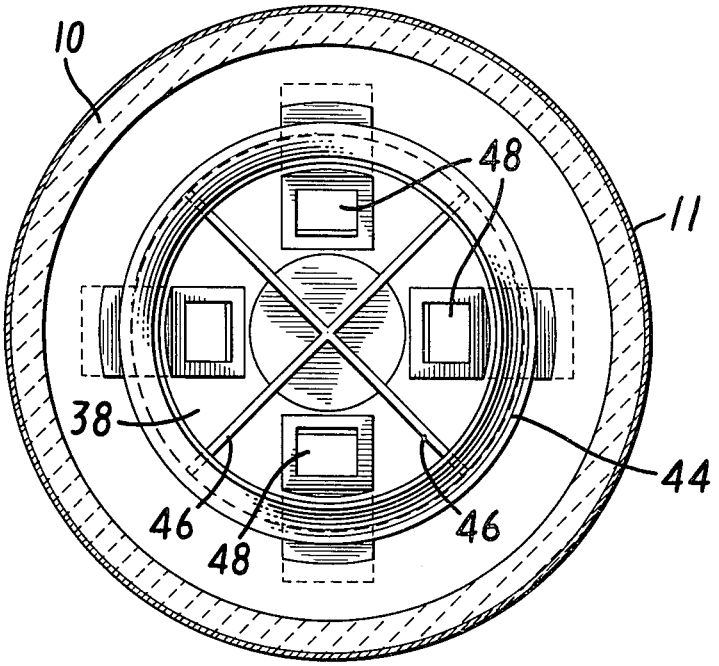
FIG. 3 is a view, taken in horizontal section, of a portion of the apparatus of FIG. 1 showing the air distributing device.

The upright shell 10 and hood 16 are preferably insulated to prevent the escape of heat to the environment. Thus, as shown in FIGS. 1–3, they may be made of insulating material such as refractory clay or the like. On the other hand, the elements arranged within the upright shell such as the mixing chute 20 are preferably made of metal. A heat-resistant alloy steel has been found to exhibit the necessary structural rigidity for this purpose.

Immediately beneath the mixing chute 20 is arranged a soaking hopper 22 which is also preferably made of a heat-resistant alloy steel. The soaking hopper forms a soaking zone or pit where some of the heat contained in the material can be used to calcine the material further and thus reduce the amount of cooling required by the cooling air. The soaking pit also serves to keep a uniform depth of material in the cooling zone below. As may be seen in FIGS. 1 and 2, the mixing chute 20 and soaking chute 22 are similar in that they taper inwardly from a large opening at the top to a smaller opening at the bottom.

A level detecting device 24 is provided in the soaking pit to sense the height of the material. This device 24 is connected to an electric, pneumatic or hydraulic unit 26 which controls the rate of extraction of material from the cooling apparatus to maintain a substantially constant level of material in the soaking pit. As shown in FIG. 2, the control unit 26 sends a signal to a material extracting mechanism 28 at the bottom of the cooling apparatus to vary its rotational speed.

Cooling air for cooling the material is provided under pressure by a blower 30 to the lower portion of the cooling apparatus. This air is directed to a first air distributor 32 and a second air distributor 34 which release air outwardly and inwardly, respectively, relative to the central axis of the shell 10 into the material to be cooled.

The first air distributor 32 is disposed centrally within the lower portion of the shell 10 and is comprised of two conical sections 36 and 38, respectively, made of steel or heat resistant alloy steel. The first section 36 has material-facing surfaces 40 extending outwardly and downwardly from the central axis of the shell, forming an annular passageway 42 for the material between these surfaces and the interior wall of the shell. The second section 38 is disposed immediately below the first section 36 and has material-facing surfaces 44 extending downwardly and inwardly from the material-facing surfaces of the first section, thereby continuing the annular passageway 42 for the material downward to the material extracting device 28.

The first air distributor 32 includes internal partitions 46 dividing the interior into several (e.g., four) air compartments. Each air compartment receives air via a separate duct 48 and releases this air through an opening 50 between the first and second sections. The air ducts 48, which extend across the annular material passageway 42, receive air from the second air distributor 34. Each duct is provided with a damper 52 having operable external linkage 54 for adjusting the rate of air flow through the duct. In this way the air may be supplied at different rates to the different compartments of the first air distributor 32.

The second air distributor 34 is configured as a toroidal "air bustle" at the base of the upright shell 10. The air bustle has material-facing surfaces 56 extending downwardly and inwardly from the interior wall of the shell forming the lower outer boundary of the annular passageway 42. The air bustle 34 is also provided with ports or openings 58 located at the upper portion of the material-facing surfaces 56 for releasing air into the annular passageway 42. Each opening 58 is supplied air through a damper 60 having operable external linkage 62 for controlling the air flow. The openings 58 and dampers 60 are located around the circumference of the cooling apparatus, the number required depending upon the size of the apparatus and the type of material to be cooled.

The dampers 52 and 60 may be adjusted to fine tune the cooling air to obtain maximum efficiency of cooling. For example, if the different sized particles of material are not arranged symmetrically about the central axis of the apparatus, the dampers may be adjusted so that the material is evenly cooled.

The annular passageway 42 for the material to be cooled extends downwardly between the material-facing surfaces 44 of the lower section 38 of the first air distributor 32 and the material-facing surfaces 56 of the second air distributor or air bustle 34. As mentioned above, the surfaces 56 flare inwardly and downwardly to direct the material to the material extracting device 28. Since the combination of cooling air path length in the lower portion of annular passageway 42 between material-facing surfaces 44 and 56 is greater than the cooling air path length above the air releasing openings 50 and 58, and the cross-sectional area for flow of cooling air in the lower portion of annular passageway 42 between material-facing surfaces 44 and 56 is much less than the cross-sectional area for flow of cooling air above the air releasing opening 50 and 58, the air moves counter to the direction of the flow of the material and does not leak or escape with the discharge of material through the material opening at the bottom of the apparatus.

Figure 4:
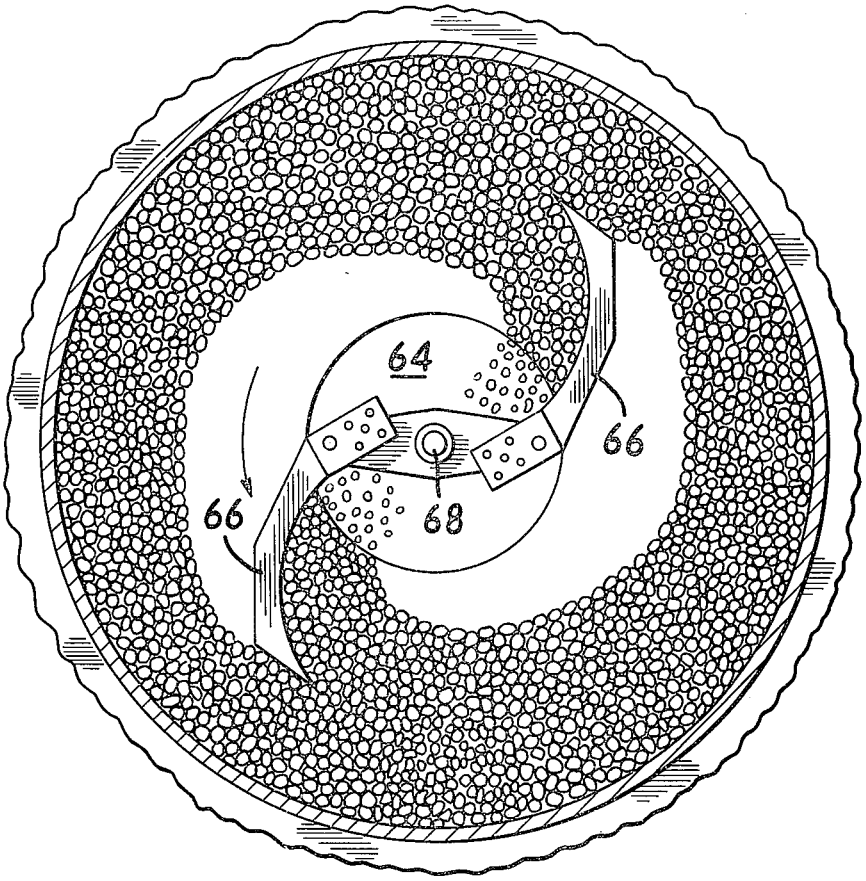
FIG. 4 is a view, taken in horizontal section, of the lower portion of the apparatus of FIG. 1 showing the material extracting device.

The material extracting device 28 illustrated in FIGS. 1, 2 and 4 is designed to continuously discharge material through an opening 64 at the bottom of the cooling apparatus. The device comprises a pair of blades 66 disposed immediately above the opening 64 and arranged to rotate with a vertically oriented shaft 68. As may be seen in FIG. 4, the blades 66 function as 'plows' to continuously draw material toward the center where it falls through the opening 64 into chutes 70. Externally operated gates 72 in the chutes 70 are used to load the material out onto one of two products conveyors 74 beneath the chutes 70 for final material handling.

Figure 6:
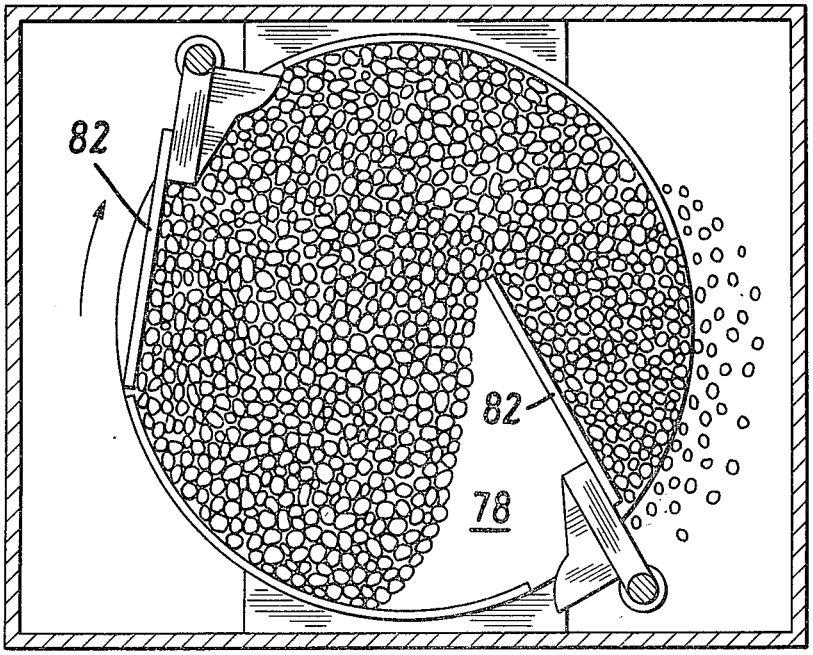
FIG. 6 is a view, taken in horizontal section, of the lower portion of the apparatus of FIG. 5, showing the material extracting device.
Figure 5:
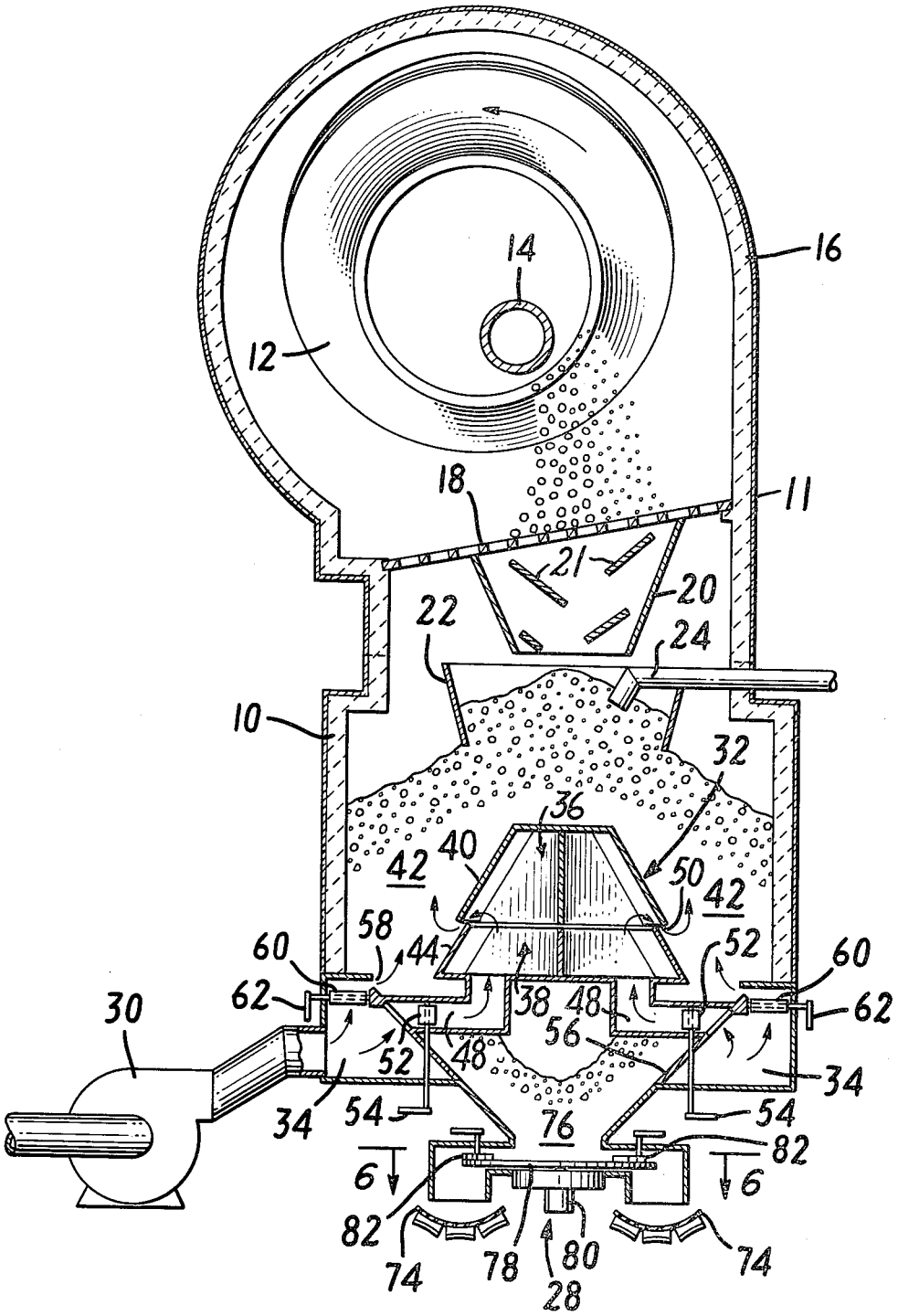
FIG. 5 is a sectional front view of cooling apparatus according to a second preferred embodiment of the present invention.

FIGS. 5 and 6 illustrate a second preferred embodiment of the coooling apparatus according to the present invention which operates in the same manner as the first embodiment but has a somewhat different structure, particularly in the lower potion thereof. As shown, the material-facing surfaces of the lower section 38 flare downwardly and outwardly to continue the conical shape of the upper section 36. The second air distributor or air bustle 34 is smaller in vertical dimension than that of the first embodiment illustrated in FIGS. 1 and 2; however, its tapered material-facing surfaces 56 form a portion of a hopper 76 which extends downward below the cylindrical shell and directs material to the material extracting device 28. In this case, the material extracting device is a table feeder having a horizontal table 78 that is rotated slowly by a shaft 80 powered by a variable speed drive. Material is extracted from the revolving table 78 by one of two adjustable knife edges 82 so that it falls onto one of the two products conveyors 74 for final material handling.

The advantage of the table feeder illustrated in FIGS. 5 and 6 over the revolving plow shown in FIGS. 1, 2, and 4 is that all parts of the table feeder are external to the cooling apparatus for ease of maintenance. Also, the table feeder effects a somewhat more efficient seal against the escape of cooling air. It will be understood that other material extracting devices, such as vibrating feeders, which are operative to continuously extract material from the bottom of the cooling apparatus may also be used.

Although the preferred embodiments of the present invention illustrated in FIGS. 1–6 and described above include a soaking pit for the purposes of final calcination, it is not intended that the present invention be limited to such an arrangement. If the calcination or sintering process is complete in the particles that enter the cooling apparatus, the soaking hopper 22 and, thus, the soaking pit may be eliminated. However, for greatest efficiency, the material level sensor 24 and its associated control unit 26 should be retained to maintain a constant path lenth through the material for the counter flow of air.

It will be understood, therefore, that the above-described embodiments are merely exemplary and that persons skilled in the art may make many variations and modifications thereto without departing from the spirt and scope of the present invention. All such variations and modifications are intended to be within the scope of the invention as defined in the appended claims.

I claim:

1. Apparatus for cooling hot, calcined particulate material comprising an upright shell adapted to contain said material, said shell having an inlet opening at its upper end for receiving said material, a discharge opening for the cooled material at the lower end of said shell, first air distributing means disposed centrally within the lower portion of said shell for releasing cooling air into said material, said first air distributing means including a first section having material-facing surfaces which flare symmetrically outwardly and downwardly about said cetral axis of said shell thereby forming an annular passageway for said material between said material-facing surfaces and the interior wall of said shell, a second section defining an air chamber beneath said first section and a continuation of the annular passageway separated from said air chamber and at least one opening from said air chamber located at the lower extremity of said material-facing surfaces for releasing air into said annular passageway, second air distributing means disposed in said lower portion and adjacent the interior wall of said shell for releasing cooling air into said material in said annular passageway, the effective cross-sectional area of the lower continuation of the annular passageway below the points of air introduced by the first and second air distributing means being less than the effective cross-sectional area of the annular passageway above the points of introduction of air so that the reduced effective cross-sectional area of the lower continuation of the annular passageway offers greater resistance to air flow and produces a countercurrent flow of cooling air upwardly through the particulate matter, and means for supplying air to said first and second air distributing means.

2. The cooling apparatus defined in claim 1, including a mixing means, disposed within the upper portion of said shell at a level below said inlet opening, for mixing together particles of said material of different size and depositing them substantially symmetrically about the central axis of said shell, said mixing means having openings at its top and bottom to permit said material to pass therethrough.

3. The cooling apparatus defined in claim 1, wherein at least a portion of said shell is insulated.

4. The cooling apparatus defined in claim 1, wherein at least a portion of said shell is made of insulating material.

5. The cooling apparatus defined in claim 2, further comprising a soaking hopper, disposed within the upper portion of said shell at a level below said mixing means, for receiving the particles of said material which fall from said mixing means and providing a soaking chamber for final calcination of said material prior to cooling.

6. The cooling apparatus defined in claim 5, wherein said soaking hopper tapers inwardly from top to bottom.

7. The cooling apparatus defined in claim 5, wherein said soaking hopper is made of metal.

8. The cooling apparatus defined in claim 7, wherein said metal is a heat-resistant alloy steel.

9. The cooling apparatus defined in claim 2, wherein said mixing means is made of metal.

10. The cooling apparatus defined in claim 9, wherein said metal is a heat-resistant alloy steel.

11. The cooling apparatus defined in claim 1, wherein said first air distributing means includes at least one internal partition dividing the interior of said first air distributing means into a plurality of air compartments.

12. The cooling apparatus defined in claim 11, wherein said first air distributing means includes a plurality of internal partitions dividing the interior of said first air distributing means into four air compartments, each of said compartments having a separate opening for releasing air into said annular passageway.

13. The cooling apparatus defined in claim 11, wherein said means for supplying air to said first air distributing means includes means for controlling the air supplied to each of said air compartments, whereby air may be supplied at different rates to said air compartments of said first air distributing means.

14. The cooling appartus defined in claim 1, wherein said first air distributing means is made of metal.

15. The cooling apparatus defined in claim 14, wherein said metal is a heat-resistant alloy steel.

16. The cooling apparatus defined in claim 1, wherein said lower portion of said shell is cylindrical, and wherein the material-facing surfaces of said first air distributing means are conically shaped.

17. The cooling apparatus defined in claim 1, wherein said second section, disposed immediately below said first section, has material-facing surfaces which extend downwardly from the material-facing surfaces of said first section, and means disposed at the lower end of said shell for continuously extracting said material through the discharge opening.

18. The cooling apparatus defined in claim 17, wherein the material-facing surfaces of said second section extend inwardly and downwardly from the material facing surfaces of said first section.

19. The cooling appartus defined in claim 17, wherein said at least one opening is located between the material-facing surfaces of said first and second sections.

20. The cooling apparatus defined in claim 17, wherein said first air distributing means further includes at least one air duct connecting said air supplying means to said second section across said annular passageway, each air duct having a damper for controlling the air flow to said second section.

21. The cooling apparatus defined in claim 20, wherein each damper includes manually operable means, extending outside of said shell, for adjusting the rate of air flow through the damper.

22. The cooling apparatus defined in claim 20, wherein said second air distributing means includes an air bustle having material-facing surfaces extending downwardly and inwrdly from the interior wall of said shell and forming the lower outer boundary of said annular passageway.

23. The cooling apparatus defined in claim 22, wherein said air bustle includes at least one opening located at the upper extremity of the material-facing surfaces thereof for releasing air into said annular passageway.

24. The cooling apparatus defined in claim 23, wherein said second air distributing means includes at least one damper for controlling the flow of air to said at least one opening thereof.

25. The cooling apparatus defined in claim 24, wherein each damper of said second air distributing means includes manually operable means, extending outside of said shell, for adjusting the rate of air flow through the damper.

26. The cooling apparatus defined in claim 22, wherein said air ducts of said first air distributing means extend from said air bustle to said second section, and wherein said means for supplying air is connected to said air bustle to supply air thereto under pressure.

27. The cooling apparatus defined in claim 1, wherein said second air distributing means has at least one opening for releasing cooling air disposed at approximately the same level as said air releasing opening of said first air distributing means.

28. An apparatus for cooling hot, calcined particulate material comprising a housing having a cooling chamber therein for receiving and cooling the hot, calcined particulate material, an air distributor located within the cooling chamber below the upper region into which the particulate material is introduced, a discharge passage from the lower region of the housing, an annular flow passage within the cooling chamber around the outer periphery of said air distributor and connecting the upper region of the cooling chamber with the discharge passage, an upper section of said annular flow passage being defined in part by a downwardly and outwardly sloped surface of the air distributor, a lower section of said annular passage extending from the outer perimeter of said outwardly and downwardly extending surface of the air distributor toward said discharge passage and means for introducing a cooling fluid into said annular flow passage at a point at which the upward flow offers less resistance than the downward flow to generate a countercurrent flow of cooling fluid through the upper section of the annular flow passage.

29. An apparatus as set forth in claim 28 including means defining an air chamber within said air distributor and beneath the downwardly and outwardly sloped surface thereof, said air chamber defining means forming the inner surface of a lower section of the annular flow passage converging toward said discharge passage.

30. An apparatus for cooling hot, calcined particulate material comprising a housing having a cooling chamber therein for receiving and cooling the hot, calcined particulate material in the upper region thereof, an air distributor located within the cooling chamber below the region into which the particulate material is introduced, a discharge passage from the lower region of the housing, an annular flow passage within the housing around the outer periphery of said air distributor connecting the upper region of the cooling chamber with the discharge passage, a downwardly and outwardly sloped upper surface of the distributor forming a wall of an upper section of the annular flow passage, a fluid chamber defined beneath the upper surface of the distributor and surrounded by the annular flow passage, and means for discharging an outward flow of cooling fluid from the fluid chamber into the annular flow passage in the region of the outer periphery of the upper surface of the air distributor where the resistance to the flow of the fluid through the lower section is greater than the resistance to the flow through the upper section to produce a countercurrent flow of cooling fluid through the upper section of the annular flow passage.

31. An apparatus as set forth in claim 30 in which the effective cross-sectional area of the annular flow passage is substantially greater above said region than below said region so that the lower section of the annular flow passage will offer greater resistance to the cooling fluid.

32. An apparatus as set forth in claim 30 including a toroidal fluid chamber around the lower section of the annular flow passage, and a fluid passage from said toroidal fluid chamber into the annular flow passage for upward countercurrent flow of cooling fluid through the upper section of the annular flow passage.

33. An apparatus as set forth in claim 32 including a plurality of bridging fluid passages across said lower section of the annular flow passage to connect the fluid chambers.

34. An apparatus as set forth in claim 33 including control means for controlling the flow of fluid through each of said bridging passages.

35. An apparatus as set forth in claim 30 including partition means subdividing said fluid chamber and a plurality of passages connecting each partitioned chamber with a source of cooling fluid.

36. An apparatus as set forth in claim 35 including a toroidal passage means around the lower section of the annular flow passage, a plurality of bridging passages establishing communication between said partitioned chambers and said toroidal chamber and control means for regulating the flow of fluid through said bridging passages.

37. An apparatus as set forth in claim 36 including fluid discharge passagemeans from the toroidal chamber into said annular flow passage for producing countercurrent flow of said cooling fluid through the particulate material in the upper section of the annular flow passage.

* * * * *